US010597267B2

(12) United States Patent
Hall et al.

(10) Patent No.: US 10,597,267 B2
(45) Date of Patent: Mar. 24, 2020

(54) VARIABLE RADIUS FAIRLEAD

(71) Applicants: David R. Hall, Provo, UT (US); Daniel Madsen, Vineyard, UT (US); Nathan Davis, Bountiful, UT (US)

(72) Inventors: David R. Hall, Provo, UT (US); Daniel Madsen, Vineyard, UT (US); Nathan Davis, Bountiful, UT (US)

(73) Assignee: Hall Labs LLC, Provo, UT (US)

( * ) Notice: Subject to any disclaimer, the term of this patent is extended or adjusted under 35 U.S.C. 154(b) by 147 days.

(21) Appl. No.: 15/880,775

(22) Filed: Jan. 26, 2018

(65) Prior Publication Data

US 2019/0233263 A1 Aug. 1, 2019

(51) Int. Cl.
*B66D 1/36* (2006.01)
*B63B 21/10* (2006.01)

(52) U.S. Cl.
CPC ..... *B66D 1/36* (2013.01); *B63B 21/10* (2013.01)

(58) Field of Classification Search
CPC ..... B66D 1/36; B63B 21/10
See application file for complete search history.

(56) References Cited

U.S. PATENT DOCUMENTS 3,048,369 A * 8/1962 Hanson ..... B66B 7/06 254/415
3,070,355 A * 12/1962 Wyatt ..... B63B 21/10 254/134.3 R
3,708,152 A * 1/1973 Bulin ..... B66D 1/36 254/327
3,976,210 A * 8/1976 Allen ..... B60P 3/41 414/559
7,302,901 B1 * 12/2007 Meyer ..... B63B 21/04 114/218
8,087,372 B1 * 1/2012 Ruffa ..... B23D 29/002 114/254
2011/0168961 A1 * 7/2011 Christiansen ..... B66D 1/36 254/327
2012/0037060 A1 * 2/2012 Chapman ..... B63B 21/04 114/218
2014/0001428 A1 * 1/2014 Fretz ..... B66D 1/02 254/395
2016/0280333 A1 * 9/2016 Trouve ..... B63B 21/10
2017/0320710 A1 * 11/2017 Fretz ..... B66D 1/36
2017/0321851 A1 * 11/2017 Fretz ..... B63B 21/14

FOREIGN PATENT DOCUMENTS

GB 1495174 A * 12/1977 ..... B63B 21/10

* cited by examiner

*Primary Examiner* — Emmanuel M Marcelo

(57) ABSTRACT

Devices, methods, and systems for a fairlead changing direction of a line under tensions are disclosed. The fairlead may include an opening with a front lip. The line under tension may be roved through the opening. The front lip may have a variable radius round. The front lip guides a change in direction of the line.

20 Claims, 10 Drawing Sheets

VARIABLE RADIUS FAIRLEAD

FIELD OF THE INVENTION

The devices, systems, and methods described herein relate generally to line redirection. More particularly, the devices, systems, and methods described herein relate to fairleads.

BACKGROUND

A typical fairlead is a device to guide a line, rope or cable around an object, out of the way or to stop it from moving too far laterally. Typically, a fairlead will be a ring or hook through which the line passes under tension. The line is moved laterally and the line contacts the fairlead, the fairlead thereby changing the direction of the line and preventing the line from rubbing against other objects that it would otherwise contact. This lowers the stress concentration of the line. Typical fairleads include roller-type fairleads, most commonly used with metal lines, and curved-edge fairleads, such as nautical leads, used with most other materials.

SUMMARY

Devices, methods, and systems for a fairlead changing direction of a line under tensions are disclosed. The fairlead may include an opening with a front lip. The line under tension may be roved through the opening. The front lip may have a variable radius round. The front lip guides a change in direction of the line.

The fairlead may be mounted on a winch, a crane, or a pulley system. The variable radius round may have a shorter radius on an inside portion of the variable-radius round and a longer radius on an outside portion of the variable radius round, or the inverse. The shape of the variable radius round may be parabolic.

A back lip of the opening may be a mirror image of the variable radius round, or a mirror image rotated 180 degrees in a plane of the opening.

The general shape of the opening may be round, elliptical, U-shaped, omega shaped, C-shaped, or rectangular with rounded corners. A portion of the fairlead may be discontinuous, resulting in a gap in the front lip.

The front lip may be made of plastics, ceramics, aluminum, steel, bronze, metal alloys, or a combination thereof. The front lip may have a low-friction surface comprising polytetrafluoroethylene, polychlorotrifluoroethylene, natural diamond, man-made diamond, chemical-vapor deposition diamond, polycrystalline diamond, or a combination thereof.

The line may be a cable, wire, line, cord, twine, strand, thread, or rope. The line may be made of nylon, polyester, polypropylene, high modulus polyethylene, aramid, carbon fiber, vegetable fibers, wood fibers, animal fibers, asbestos fibers, or a combination thereof.

BRIEF DESCRIPTION OF THE DRAWINGS

In order that the advantages of the described devices, systems, and methods will be readily understood, a more particular description of the described devices, systems, and methods briefly described above will be rendered by reference to specific embodiments illustrated in the appended drawings. Understanding that these drawings depict only typical embodiments of the described devices, systems, and methods and are not therefore to be considered limiting of its scope, the devices, systems, and methods will be described and explained with additional specificity and detail through use of the accompanying drawings, in which.

DETAILED DESCRIPTION

It will be readily understood that the components of the described devices, systems, and methods, as generally described and illustrated in the Figures herein, could be arranged and designed in a wide variety of different configurations. Thus, the following more detailed description of the embodiments of the described devices, systems, and methods, as represented in the Figures, is not intended to limit the scope of the described devices, systems, and methods, as claimed, but is merely representative of certain examples of presently contemplated embodiments in accordance with the described devices, systems, and methods.

Cables, wires, lines, cords, twine, strands, thread, and ropes will all be referred to herein as 'lines.' A fillet is a rounding of an interior or exterior corner of a part design, though it generally refers to interior corners. The rounding of an exterior corner is commonly referred to as a "round." In the present application, the term "round" will be used to refer to a rounded exterior corner, or lip, of a part. The word "to rove" means to put fibers through an eye or opening.

Vegetable fibers include but are not limited to cotton, hemp, jute, flax, ramie, sisal, bagasse, and banana. Wood fibers include but are not limited to groundwood, lacebark, thermomechanical pulp, and bleached or unbleached kraft or sulfite pulps. Animal fibers include silkworm silk, spider silk, sinew, catgut, wool, sea silk; hair such as cashmere wool, mohair, and angora; and fur such as sheepskin, rabbit, mink, fox, and beaver.

A fairlead is used to change the direction of a line while preventing the stress concentration of the point in the line that changes direction from exceeding the line's stress tolerances. The curved-edge fairleads of which the Applicant is aware all have constant radius rounds as edges or lips. The devices, systems, and methods of the present application improve upon the curved-edge fairlead by use of a variable radius round as a lip, rather than the constant radius round. The variable radius round edge allows for a more gradual change of direction by the line, resulting in less stress on the line upon direction changes. In one embodiment, the ratio of the longest radius of the round to the shortest radius of the round is greater than 1. In a preferred embodiment, the ratio is at least 1.5. In a more preferred embodiment, the ratio is at least 2. In a most preferred embodiment, the ratio is at least 2.5.

The fairlead may be an integral part of a larger structure or a separate piece of hardware.

Figure 1A:
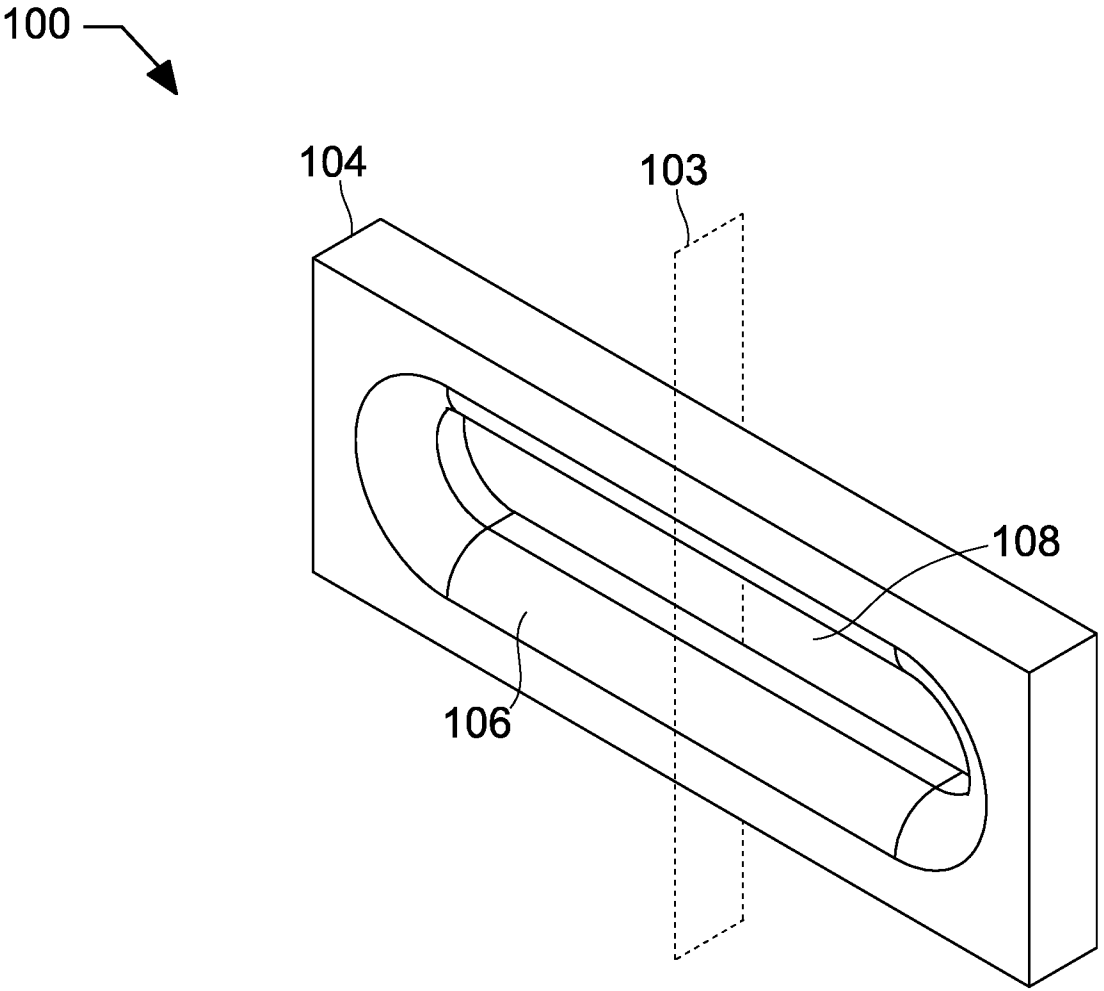
FIG. 1A is a top-right isometric elevation view of a fairlead.
Figure 1B:
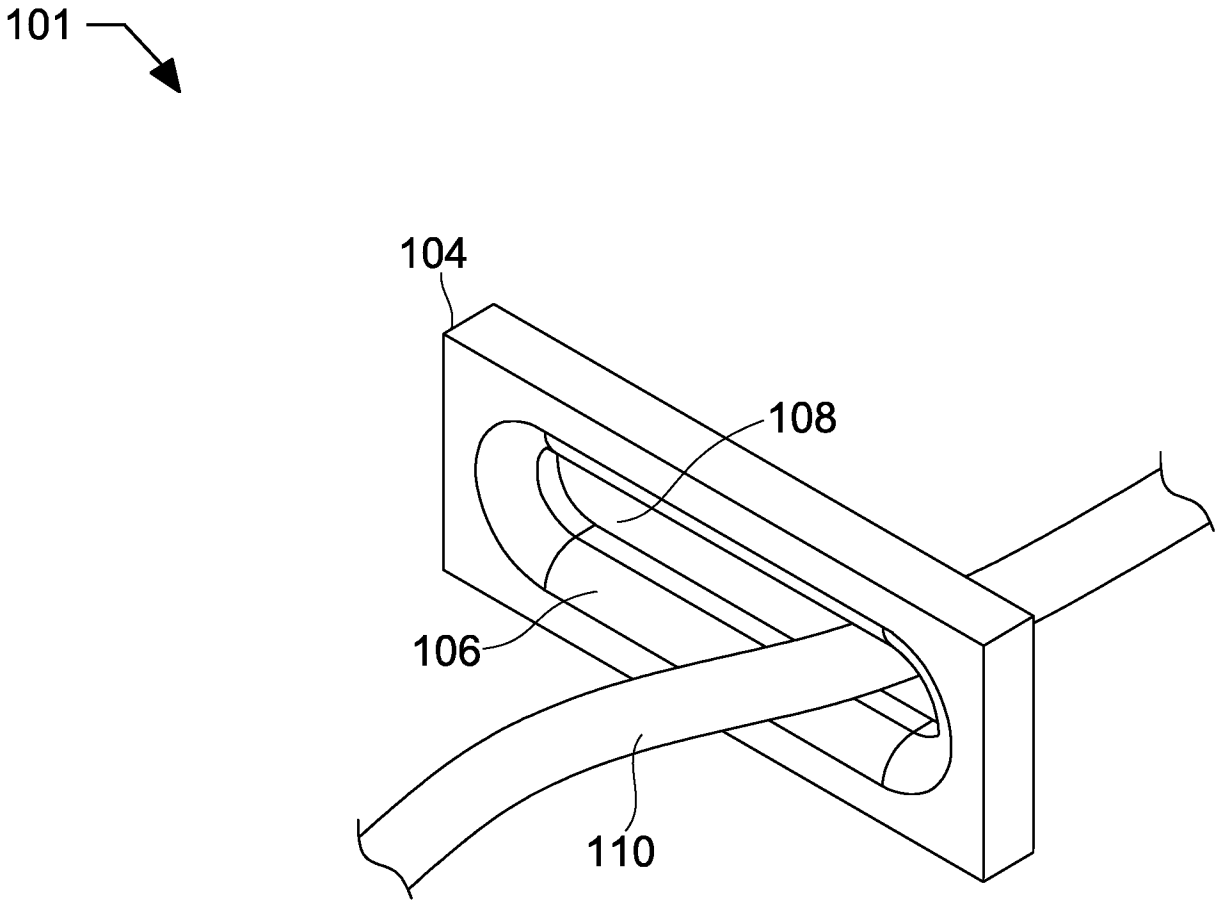
FIG. 1B is a top-right isometric elevation view of the fairlead of FIG. 1A with a line rove through the opening.
Figure 1C:
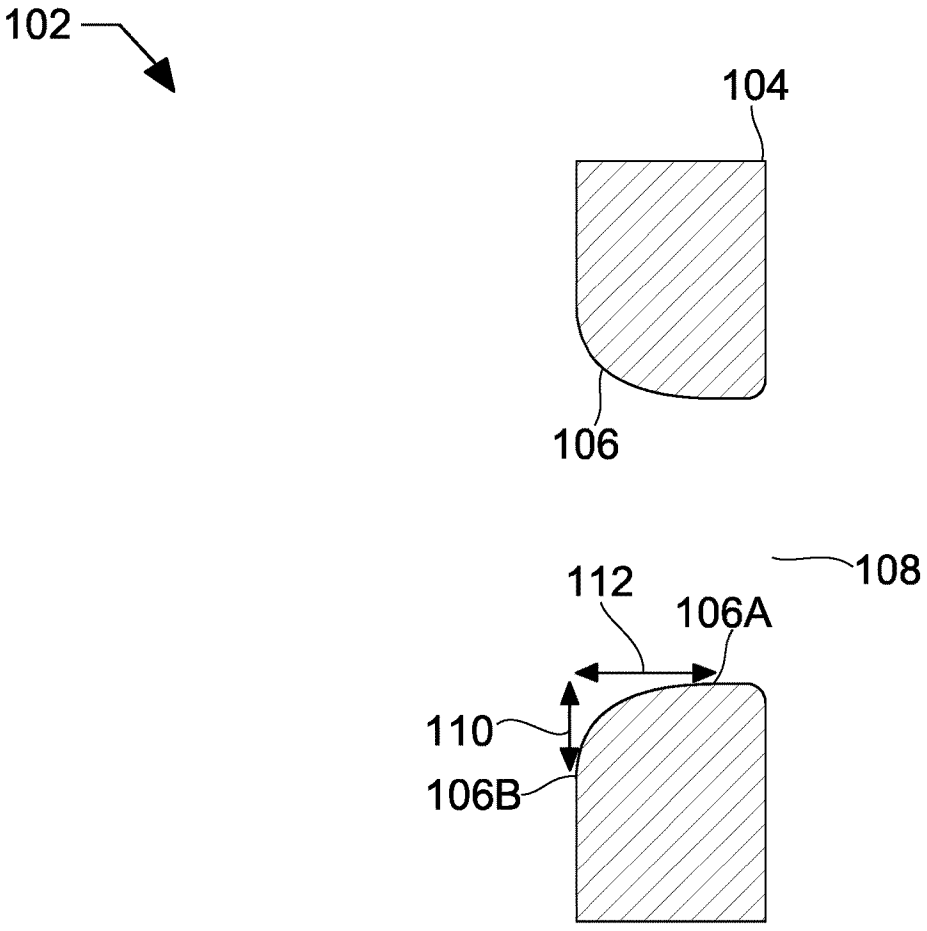
FIG. 1C is a cross-sectional side view of the fairlead of FIG. 1A.
Figure 1D:
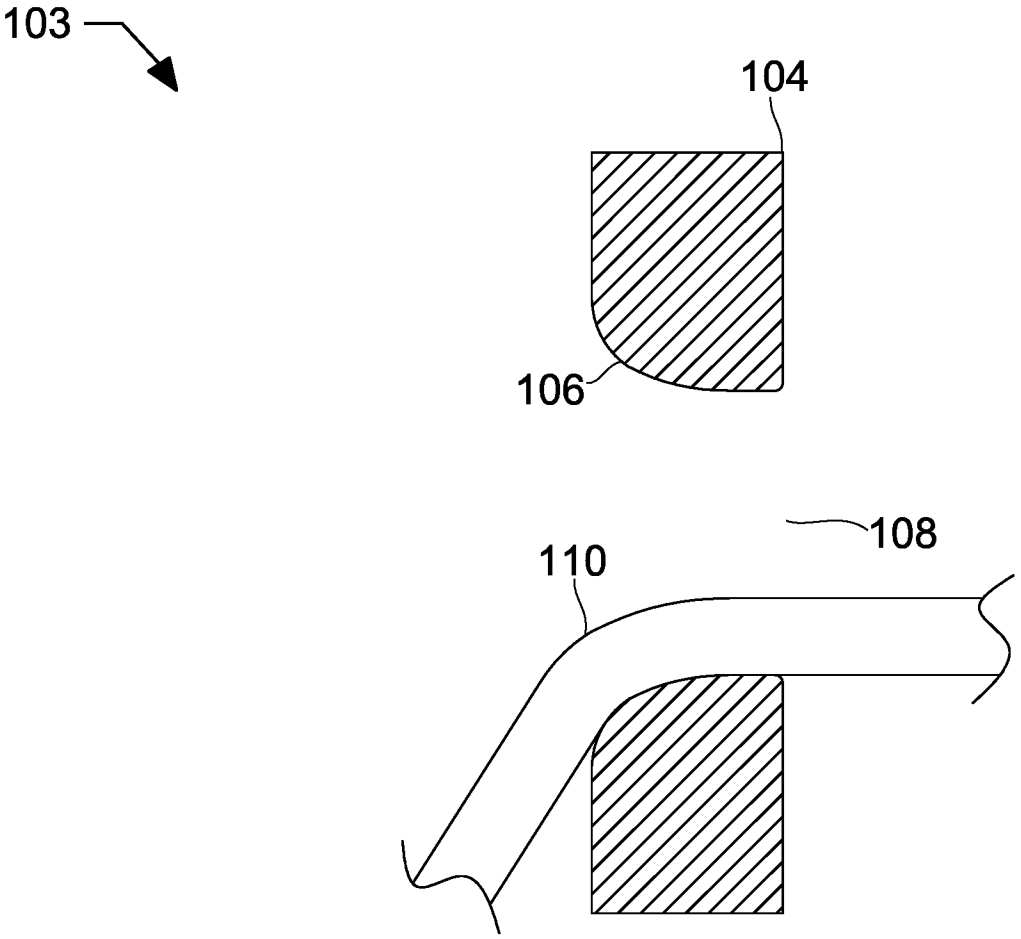
FIG. 1D is the same cross-sectional side view of the fairlead of FIG. 1A, with the line 110 included.

Referring now to the Figures, FIG. 1A is a top-right isometric elevation view 100 of a fairlead 104 that may be used in the devices, methods, and systems disclosed herein. FIG. 1B is a top-right isometric elevation view 101 of the fairlead 104 of FIG. 1A with a line 110 rove through opening 108. FIG. 1C is a cross-sectional side view 103 of the fairlead 104. FIG. 1D is the same cross-sectional side view 103 of the fairlead 104, with the line 110 included. Fairlead 104 has a generally rectangular-shaped opening 108 with rounded corners. The front lip 106 of the opening 108 is a variable radius round. In other words, the curve of front lip 106 has a first radius 110 that is less than a second radius 112. The radius decreases gradually from the beginning 106A of front lip 106 to the end 106B of front lip 106. In this embodiment, the shape is generally parabolic, with the change in radius generally following the quadratic. Logarithmic, exponential, cubic, or other curves could also be used in other embodiments. Line 110 is rove through opening 108. Line 110 is under tension and is moved laterally against front lip 106, changing the direction of line 110. Due to the shape of front lip 106, line 110 changes direction as needed, but with reduced stress in line 110 at the point of contact with front lip 106 when compared to a constant radius round lip.

Figure 2A:
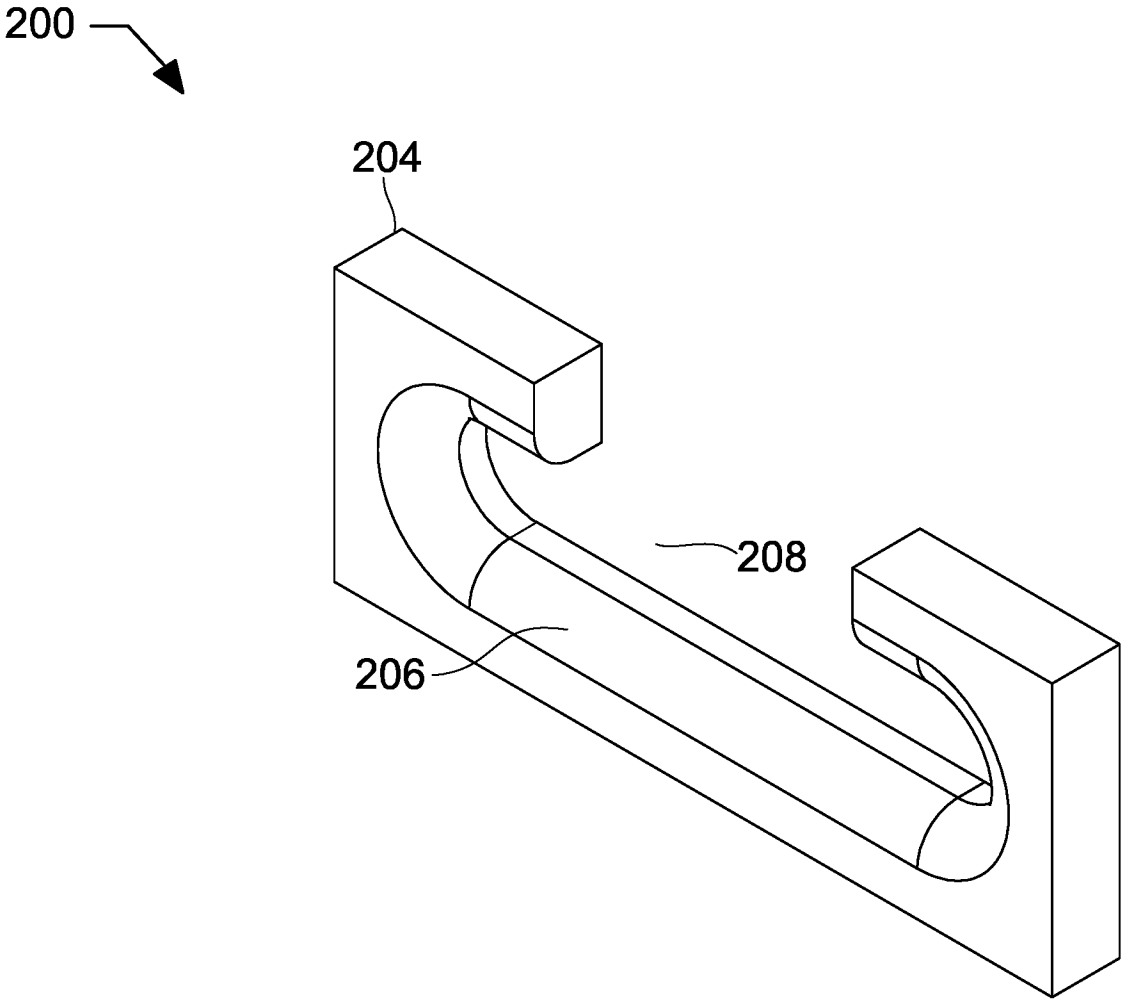
FIG. 2A is a top-right isometric elevation view of a nautical fairlead.
Figure 2B:
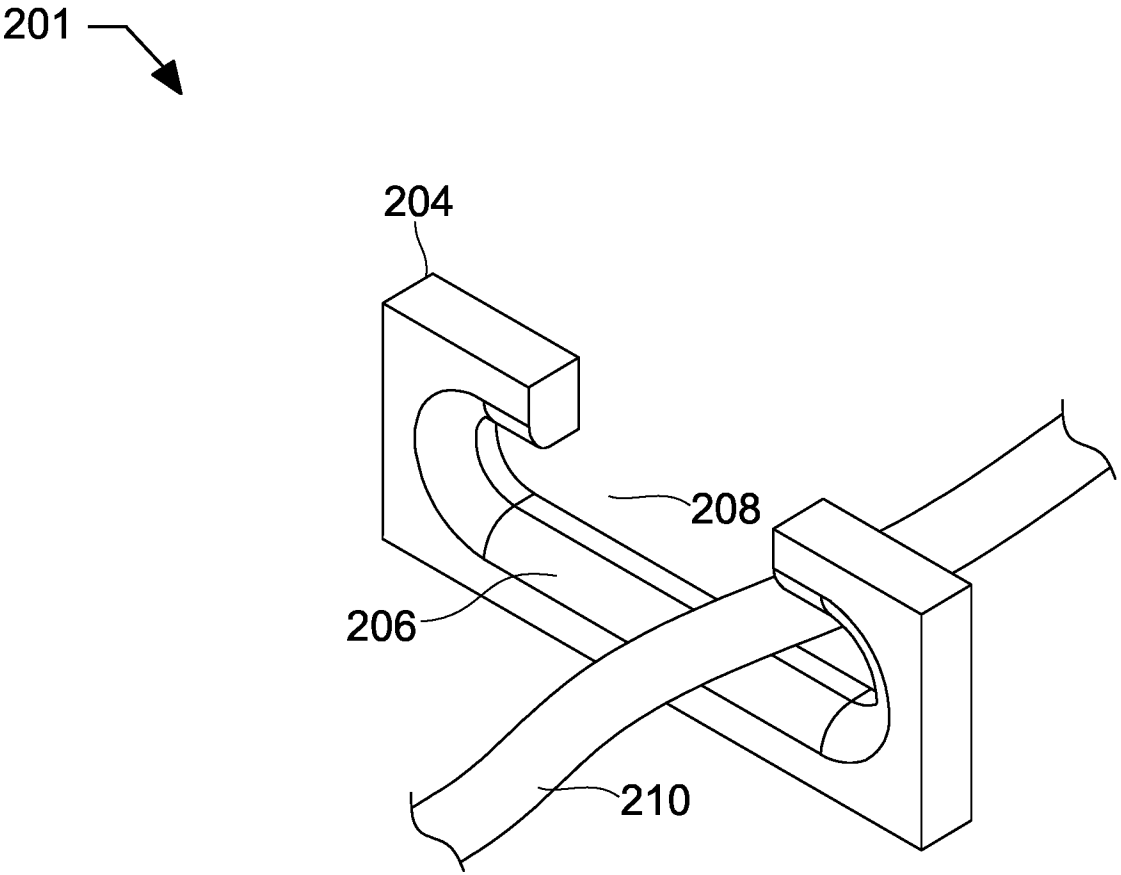
FIG. 2B is a top-right isometric elevation view of the fairlead of FIG. 2A with a line rove through the opening.

Referring now to FIG. 2, FIG. 2A is a top-right isometric elevation view 200 of a nautical fairlead 204 that may be used in the devices, methods, and systems disclosed herein. FIG. 2B is a top-right isometric elevation view 201 of the fairlead 204 of FIG. 2A with a line 210 rove through opening 208. Fairlead 204 has a generally rectangular-shaped opening 208 with rounded corners, as in FIG. 1A, except the top portion of the fairlead 204 is removed, resulting in an elongated "C" shape. This style of fairlead is known as a "nautical" fairlead, as the shape makes quick attachment and detachment of lines on ocean going vessels possible without threading the line through an opening. The front lip 206 of the opening 208 is a variable radius round, as in FIG. 1A. In other words, the curve of front lip 206 is like that of FIG. 1A. Line 210 is under tension and is moved laterally against front lip 206, changing the direction of line 210. Due to the shape of front lip 206, line 210 changes direction as needed, but with reduced stress in line 210 at the point of contact with front lip 206 when compared to a constant radius round lip.

Figure 3A:
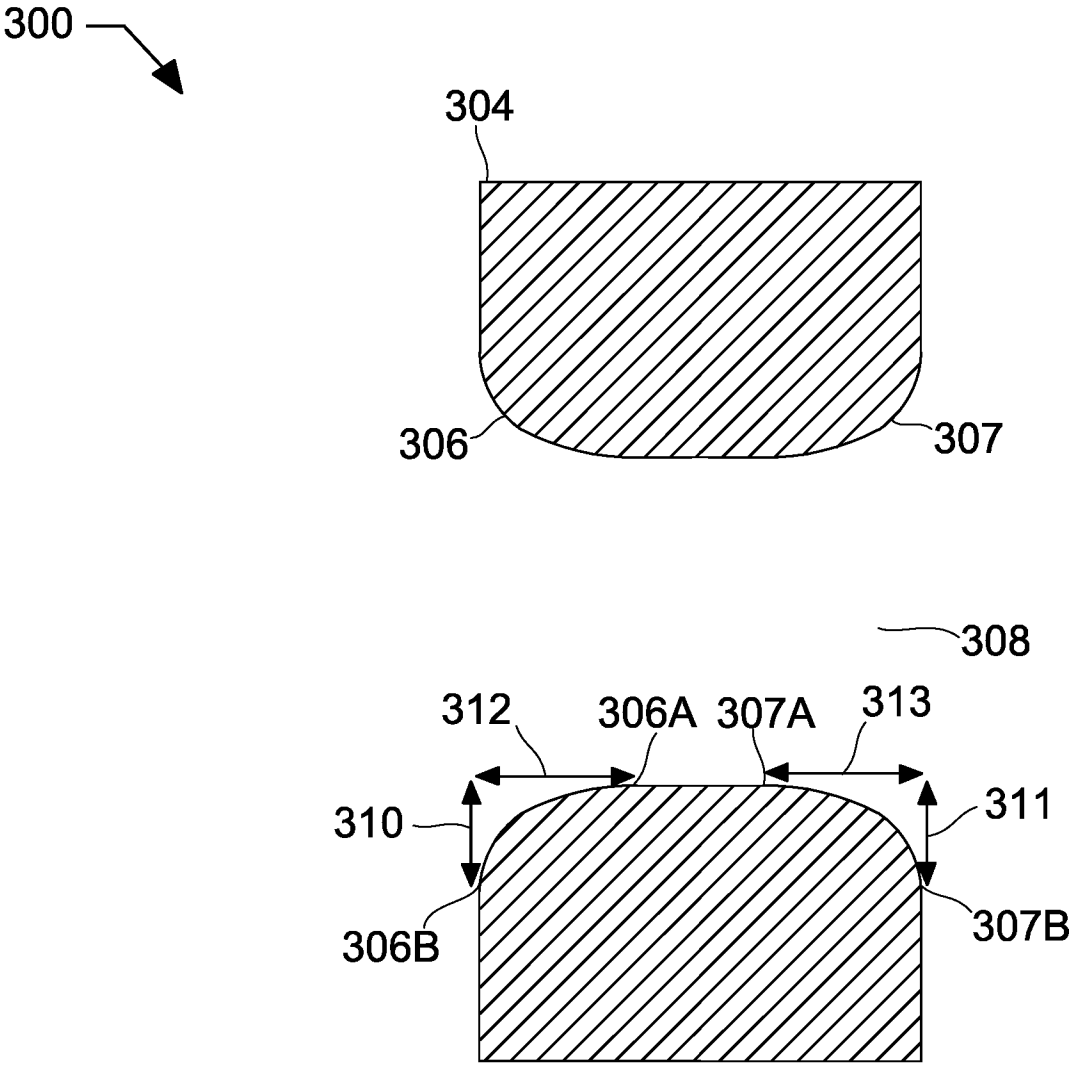
FIG. 3A is a cross-sectional side view of a fairlead.
Figure 3B:
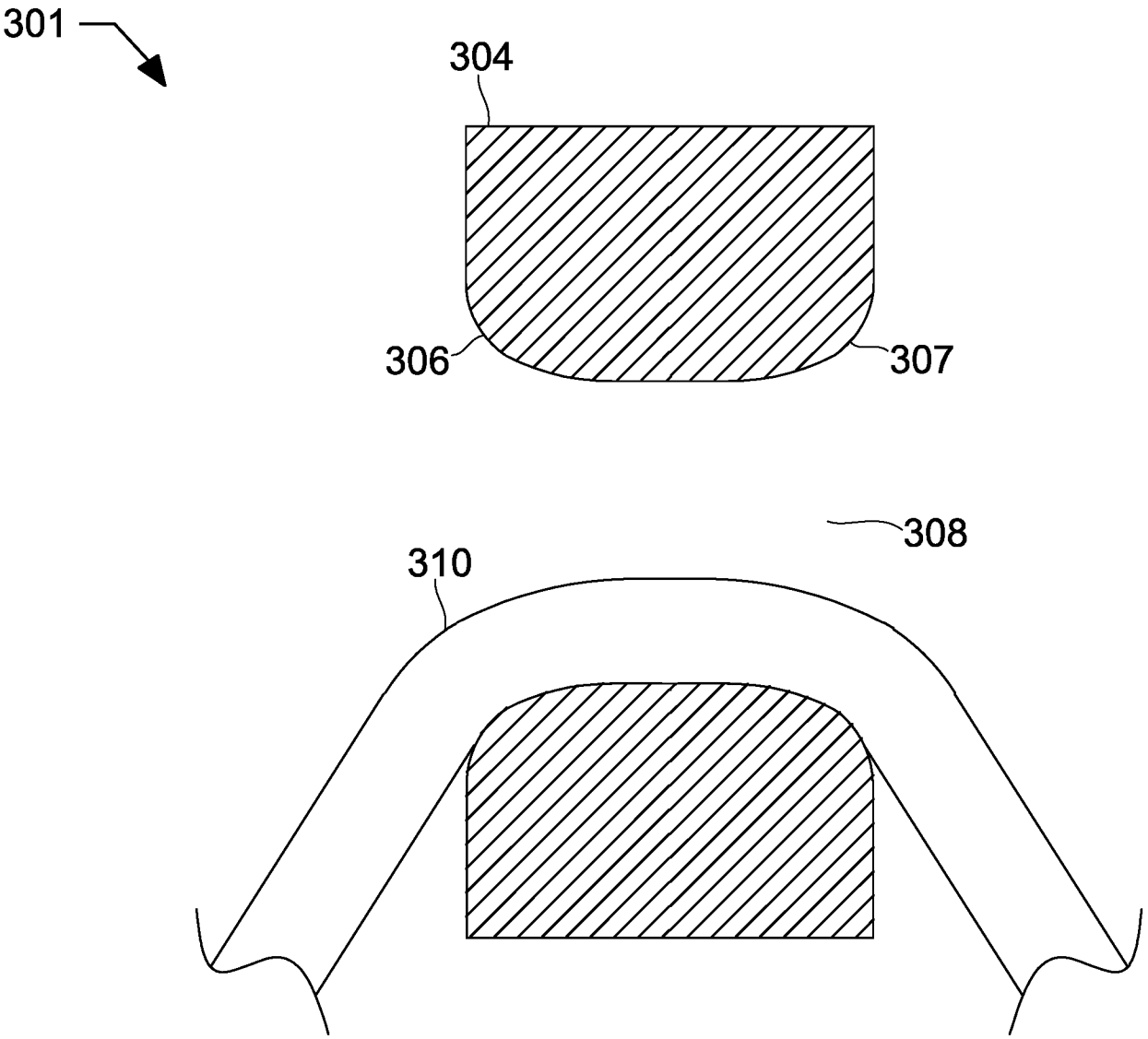
FIG. 3B is a cross-sectional side view of FIG. 3A, with a line added.

Referring now to FIG. 3, FIG. 3A is a cross-sectional side view 300 of a fairlead 304 (e.g., 104, 204) that may be used in the devices, methods, and systems disclosed herein. FIG. 3B is a cross-sectional side view 301 of FIG. 3A, with line 310 added. Fairlead 304 has a front lip 306 that is a variable radius round. In other words, the curve of front lip 306 has a first radius 310 that is less than a second radius 312. The radius decreases gradually from the beginning 306A of front lip 306 to the end 306B of front lip 306. Back lip 307 is a mirror image of this variable radius round. In other words, the curve of back lip 307 has a first radius 311 that is less than a second radius 313. The radius increases gradually from the beginning 307B of back lip 307 to the end 307A of back lip 307. Line 310 is under tension and is moved laterally against front lip 306 and back lip 307, changing the direction of line 310. Due to the shape of front lip 306 and back lip 307, line 310 changes direction as needed, but with reduced stress in line 310 at the points of contact with front lip 306 and back lip 307 when compared to a constant radius round lip.

Figure 4A:
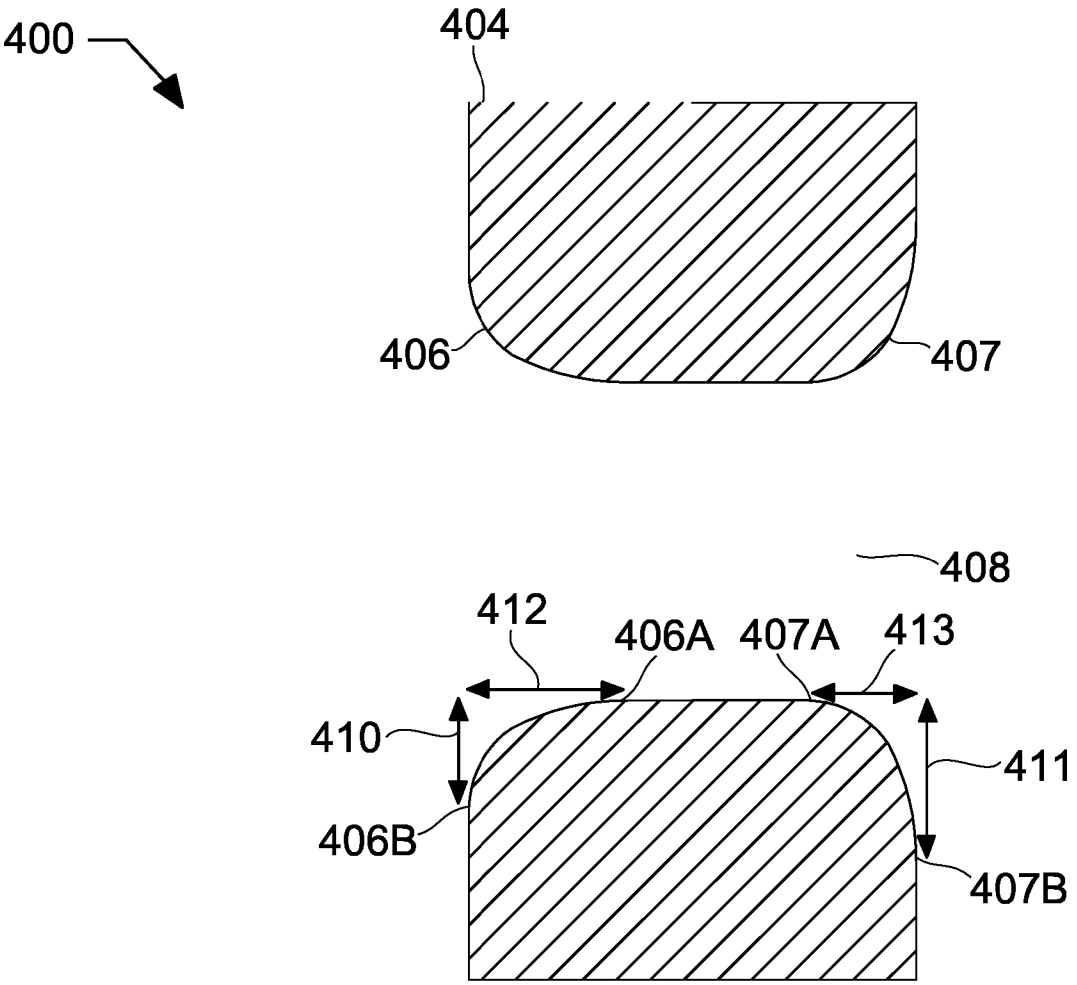
FIG. 4A is a cross-sectional side view of a fairlead.
Figure 4B:
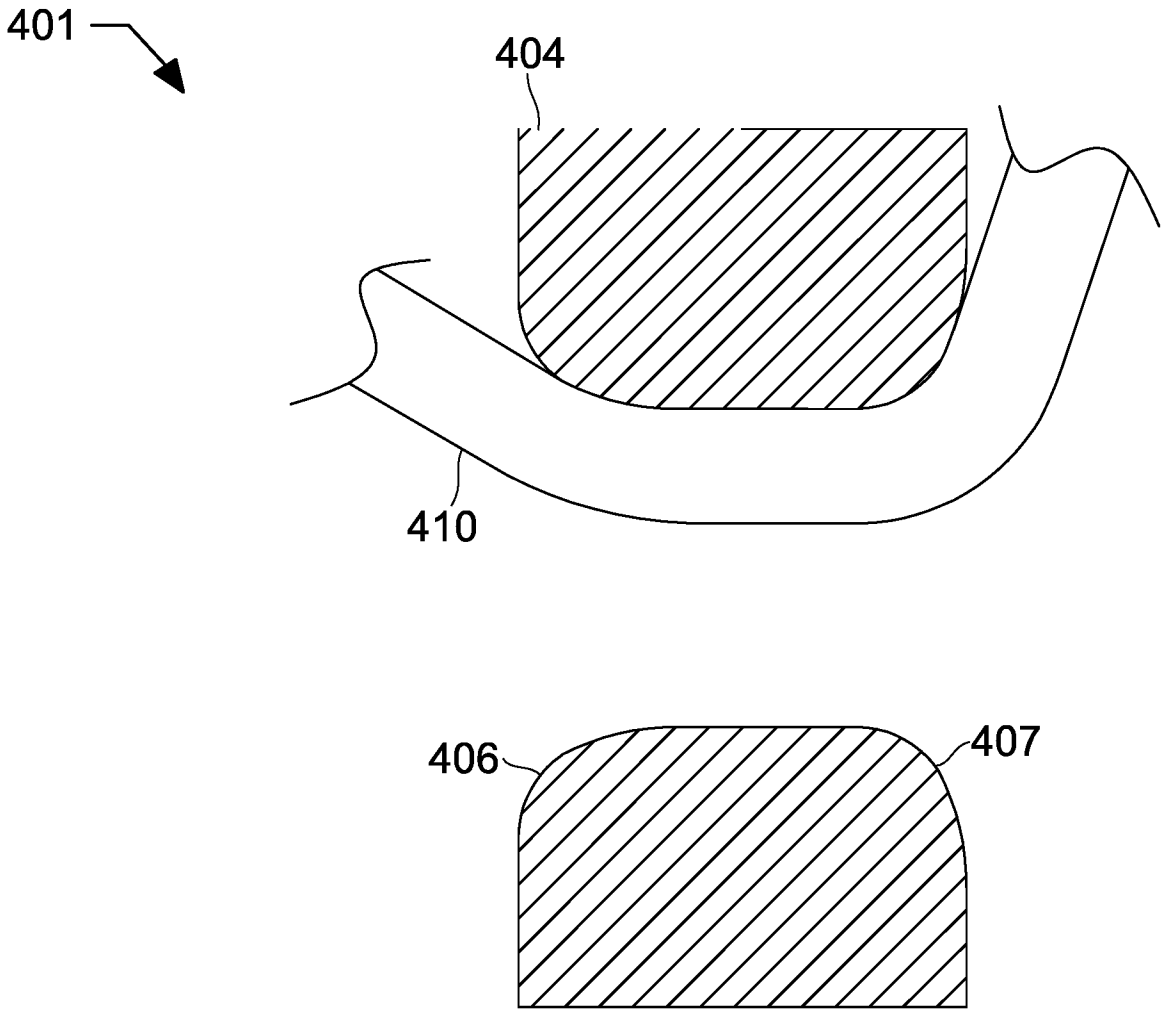
FIG. 4B is a cross-sectional side view of FIG. 4A, with a line added.

Referring now to FIG. 4, FIG. 4A is a cross-sectional side view 400 of a fairlead 404 (e.g., 104, 204, 304) that may be used in the devices, methods, and systems disclosed herein. FIG. 4B is a cross-sectional side view 401 of FIG. 4A, with line 410 added. Fairlead 404 has a front lip 406 that is a variable radius round. In other words, the curve of front lip 406 has a first radius 410 that is less than a second radius 412. The radius decreases gradually from the beginning 406A of front lip 406 to the end 406B of front lip 406. Back lip 407 is a 90-degree rotation of this variable radius round. In other words, the curve of back lip 407 has a first radius 411 that is greater than a second radius 413. The radius decreases gradually from the beginning 407B of back lip 407 to the end 407A of back lip 407. Line 410 is under tension and is moved laterally against front lip 406 and back lip 407, changing the direction of line 410. Due to the shape of front lip 406 and back lip 407, line 410 changes direction as needed, but with reduced stress in line 410 at the points of contact with front lip 406 and back lip 407 when compared to a constant radius round lip.

In both FIGS. 3 and 4, the orientations of the variable radius round can be alternated depending upon the angle at which the line is coming into the opening, and the angle at which it leaves the opening. In some instances, using the bottom half of FIG. 3 and the top half of FIG. 4 would be optimal for the line to pass with minimal stress. In others, the opposite may be best.

In some embodiments, the fairlead may be mounted on a winch, a crane, or a pulley system.

In some embodiments, the variable radius round has a shorter radius on an inside portion of the variable-radius round and a longer radius on an outside portion of the variable radius round. In other embodiments, the variable radius round has a shorter radius on an outside portion of the variable-radius round and a longer radius on an inside portion of the variable radius round.

In some embodiments, the general shape of the opening may be round, elliptical, U-shaped, omega shaped (as in ship warping fairleads), C-shaped, or rectangular with rounded corners.

In some embodiments, a portion of the fairlead is discontinuous, resulting in a gap in the front lip, as in ship warping fairleads.

In some embodiments, the front lip is plastic, ceramic, aluminum, steel, bronze, a metal alloy, or a combination thereof. In some embodiments, the front lip is a low-friction surface comprising polytetrafluoroethylene, polychlorotrifluoroethylene, natural diamond, man-made diamond, chemical-vapor deposition diamond, polycrystalline diamond, or a combination thereof.

In various embodiments, the line may be a cable, wire, line, cord, twine, strand, thread, or rope.

In some embodiments, the line is made of nylon, polyester, polypropylene, high modulus polyethylene, aramid, carbon fiber, vegetable fibers, wood fibers, animal fibers, asbestos fibers, or a combination thereof.

The invention claimed is:

1. A fairlead comprising:

an opening through which a line under tension is rove;

a front lip of the opening comprising a variable radius round;

the front lip guides a change in direction of the line, and a back lip of the opening comprising a mirror image of the variable radius round.

2. The fairlead of claim 1, wherein the fairlead is mounted on a winch, a crane, or a pulley system.

3. The fairlead of claim 1, wherein the variable radius round has a shorter radius on an inside portion of the variable-radius round and a longer radius on an outside portion of the variable radius round.

4. The fairlead of claim 1, wherein the variable radius round has a shorter radius on an outside portion of the variable-radius round and a longer radius on an inside portion of the variable radius round.

5. The fairlead of claim 1, wherein a shape of the variable radius round is parabolic.

6. The fairlead of claim 1, wherein a general shape of the opening is round, elliptical, U-shaped, omega shaped, C-shaped, or rectangular with rounded corners.

7. The fairlead of claim 6, wherein a portion of the fairlead is discontinuous, resulting in a gap in the front lip.

8. The fairlead of claim 1, wherein the front lip comprises plastics, ceramics, aluminum, steel, bronze, metal alloys, or a combination thereof.

9. The fairlead of claim 8, wherein the front lip comprises a low-friction surface comprising polytetrafluoroethylene, polychlorotrifluoroethylene, natural diamond, man-made diamond, chemical-vapor deposition diamond, polycrystalline diamond, or a combination thereof.

10. The fairlead of claim 1, wherein the line comprises cables, wires, lines, cords, twine, strands, threads, or ropes.

11. The fairlead of claim 10, wherein the line comprises nylon, polyester, polypropylene, high modulus polyethylene, aramid, carbon fiber, vegetable fibers, wood fibers, animal fibers, asbestos fibers, or a combination thereof.

12. The fairlead of claim 1, wherein the variable radius round has a shortest radius and a longest radius, and wherein the ratio of the longest radius and the shortest radius is greater than 1.

13. The fairlead of claim 1, wherein the variable radius round has a shortest radius and a longest radius, and wherein the ratio of the longest radius and the shortest radius is greater than 1.5.

14. The fairlead of claim 1, wherein the variable radius round has a shortest radius and a longest radius, and wherein the ratio of the longest radius and the shortest radius is greater than 2.

15. The fairlead of claim 1, wherein the variable radius round has a shortest radius and a longest radius, and wherein the ratio of the longest radius and the shortest radius is greater than 2.5.

16. A fairlead comprising:

an opening through which a line under tension is rove;

a front lip of the opening comprising a variable radius round;

the front lip guides a change in direction of the line; and a back lip of the opening comprising a 90 degree rotation of the variable radius round.

17. The fairlead of claim 16, wherein the fairlead is mounted on a winch, a crane, or a pulley system.

18. The fairlead of claim 16, wherein the variable radius round has a shorter radius on an inside portion of the variable-radius round and a longer radius on an outside portion of the variable radius round.

19. The fairlead of claim 16, wherein the variable radius round has a shorter radius on an outside portion of the variable-radius round and a longer radius on an inside portion of the variable radius round.

20. The fairlead of claim 16, wherein a shape of the variable radius round is parabolic.

* * * * *